United States Patent [19]

Gainer, Jr.

[11] 3,960,554

[45] June 1, 1976

[54] POWDERED METALLURGICAL PROCESS FOR FORMING VACUUM INTERRUPTER CONTACTS

[75] Inventor: Robert E. Gainer, Jr., Monroeville, Pa.

[73] Assignee: Westinghouse Electric Corporation, Pittsburgh, Pa.

[22] Filed: June 3, 1974

[21] Appl. No.: 476,177

[52] U.S. Cl. ..... 75/200; 29/182.1; 29/182.2; 75/214; 75/221; 75/225

[51] Int. Cl.[2] ..... B22F 3/00; B22F 1/00; B22F 1/02; B22F 1/04

[58] Field of Search ..... 29/182, 182.1, 182.2; 75/200, 214, 225, 221

[56] References Cited

UNITED STATES PATENTS

| | | | |
|---|---|---|---|
| 2,362,007 | 10/1944 | Hensel | 75/221 |
| 2,401,221 | 5/1946 | Bourne | 29/182.2 |
| 2,656,595 | 10/1953 | Stern | 29/182.2 |
| 2,758,229 | 8/1956 | Perry | 310/231 |
| 2,807,542 | 9/1957 | Frank | 75/214 |
| 3,338,687 | 8/1967 | Dickinson | 29/182.2 |
| 3,353,931 | 11/1967 | Zdanuk | 29/182.2 |
| 3,360,348 | 12/1967 | Schreiner | 29/182.1 |
| 3,366,463 | 1/1968 | Schreiner | 29/182.2 |
| 3,585,342 | 6/1971 | Kosco | 29/182.2 |
| 3,619,170 | 11/1971 | Fisher | 29/182.1 |
| 3,859,087 | 1/1975 | Backstrom | 29/182 |

*Primary Examiner*—Benjamin R. Padgett
*Assistant Examiner*—Donald P. Walsh
*Attorney, Agent, or Firm*—W. A. Elchik

[57] ABSTRACT

A powdered metallurgical procedure for forming chromium copper contacts used in vacuum interrupters, wherein by adding a small amount of copper powder to the difficult-to-press chromium powder, superior pressed properties are attained and a resulting chromium compact having higher green strength is produced. By practicing the teaching of this invention, vacuum interrupter contacts can be pressed to complex shapes. It is desirable to have a vacuum interrupter contact having an approximately 50% chromium composition. The low compacting pressure necessary to produce a 40% to 60% chromium powder concentrations yields a compact having a very low green strength which cannot be ejected from a die without falling apart; by adding a small amount of copper powder to the chromium powder before pressing a compact having a much higher green strength, which can be readily handled, is obtained. Using the disclosed process a press to shape contact having a variable density can be attained. This process can be used to produce a desirable chromium compact having a high density on the peripheral areas which decreases to a lower density in the center contact area.

7 Claims, 2 Drawing Figures

POWDERED METALLURGICAL PROCESS FOR FORMING VACUUM INTERRUPTER CONTACTS

CROSS REFERENCES TO RELATED APPLICATIONS

This application is related to patent application Ser. No. 509,163 Westinghouse Case No. 45,274.

BACKGROUND OF THE INVENTION

The present invention relates to vacuum type circuit interrupters and more particularly to a method for forming the contact structure which is a part of such vacuum interrupters. This application discloses an improved method for manufacturing a chromium copper contact for use in a vacuum circuit interrupter.

Vaccum type circuit interrupters generally comprise an evacuated insulating envelope having separable contacts disposed within the insulating envelope. The contacts are movable between a closed position in which the contacts are engaged and an open when the contacts are separated and an arcing gap is established therebetween. An arc is initiated between the contact surfaces when the contacts move into or out of engagement while the circuit in which the interrupter is used is energized.

When the contacts are brought together the arc that is formed melts and vaporizes some contact material. After the contacts are brought together under high pressure engagement welds may be formed between the contact surfaces due to the melted contact material formed during arcing. Current surges also occur in the first few milliseconds of contact closing and these can also cause contact welding. The magnitude of the force required to break the weld so that the contacts can be opened depends upon many factors including the arc voltage and current, the contact area, and the contact material. These welds are objectionable since they interfere with the easy movement of the separable contacts and may result in the failure of the vacuum interrupter to open.

Another difficulty that is sometimes encountered with vacuum interrupter contacts is that materials used have excessive tendency to chop under low current conditions. This sharp chop in current can induce extremely high voltages across inductive devices connected in the circuit being interrupted, and such overvoltages can lead to destruction of circuit components. For an effective vacuum interrupter there should not be an excessive current chop on circuit opening.

It has been determined that an arc rotating contact formed from a 50% porous chromium matrix that is copper infiltrated is desirable for use in a vacuum interrupter. Approximately a 1/1 Cr-Cu ratio in the finished contact has been established as developing a low resistance contact having low strength weld and arc quenching characteristics necessary for a vacuum interrupter. The low compacting pressure, approximately twelve tons per square inch, necessary to produce a 50% dense chromium powder compact yields a compact having a very low green strength which cannot be ejected from a die without falling apart. Therefore, the compaction and sintering have to be carried out in a containment vessel for the copper during infiltration prior to machining to shape. For a normal spoked arc rotating contact, extensive machining is required to achieve the radial slots, the rimmed hole for the connecting rod and the intricate contact area. Heat generated by the extensive machining can also cause contamination of the contact because of the high affinity chromium has for nitrogen. To reduce manufacturing cost and to improve productivity it is desirable to have a process whereby a vacuum interrupter chromium copper contact can be pressed to the desired final shape.

SUMMARY OF THE INVENTION

In order to improve the compact green strength and make die ejection possible without substantially varying from the required approximate 50% porosity of the chromium powder, premixing of a copper binder with the chromium powder is utilized. The blending produces a higher green strength compact enabling easy die ejection and permitting subsequent handling. The low percentage of copper added and the slightly higher compacting pressure required does not adversely effect the sintering of the chromium of the final properties of the copper chromium contact.

Utilizing the teaching of this invention a 50% chromium press to shape chromium copper contact is now possible. The contact can either be pressed to a final shape requiring no machining or to shape which minimizes machining. An additional advantage of the press to shape contact is that a variable contact density can be obtained. A chromium contact can be produced having a high density on the peripheral area which decreases to a low density in the center contacting area. Thus when infiltrated with copper the outer contact petals have a high chromium to copper ratio providing mechanical strength and the center portion has a high copper to chromium ratio for higher current carrying capacity when the contacts are closed. The compact thus has a high strength outer ring supporting the lower strength center.

A composite structure can also be created by using this powdered metallurgical technique. Thus a two part contact, top and bottom sections of different material, can be produced. These sections are then joined during the infiltration step. The basic idea is to have a top section of copper chromium material while the bottom section can be of some other material which would reduce cost and/or improve contact properties.

Utilizing the teaching of the present invention it is possible to manufacture press to shape variable density contacts which performs as well or better than the prior art contacts. Pressing to shape will reduce machining and be an advantage and cost saving over the present manufacturing process. The addition of up to 10% by weight of copper premixed with the chromium powder will improve green strength and improve the handleability of the press compact. Compacting pressures up to 20 tons per square inch in conjunction with the copper additive will produce compacts having improved green strength while still having the required porosity or density.

It is an object of this invention to teach a method of forming a vacuum interrupter contact wherein a green compact comprising mostly chromium can be pressed to a complex shape, ejected from a die, sintered and infiltrated with copper to for a contact comprising 40 to 60 percent chromium.

It is another object of this invention to disclose a variable density chromium-copper contact for use in a vacuum circuit interrupter.

BRIEF DESCRIPTION OF THE DRAWINGS

For a better understanding of the invention, reference may be had to the preferred embodiment exemplary of the invention shown in the accompanying drawings, in which.

DESCRIPTION OF THE PREFERRED

EMBODIMENTS

A major component of some vacuum interrupters are two chromium copper low resistant contacts. In prior art practices, these are manufactured by lightly compacting chromium powder, vacuum sintering, copper infiltrating and then finish machining. This procedure is expensive, and machining is considered detrimental to the contact purity and subsequent performance.

Figure 1:
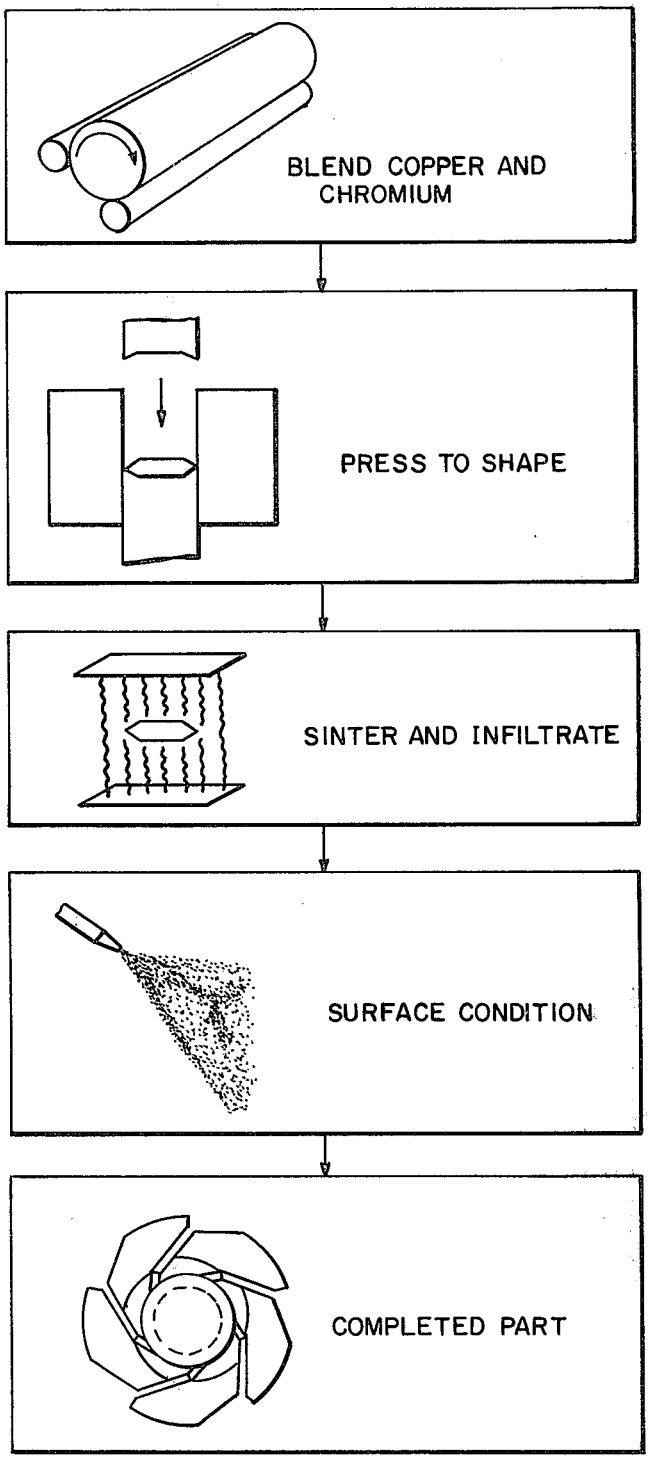
FIG. 1 shows the steps to practice the teaching of the present invention.

A powdered metallurgical process has been developed which enables the manufacturing cost to be lowered because of a reduced number of processing steps and machining operations. FIG. 1 shows the steps in an ideal powder metallurgical procedure for forming a vacuum interrupter contact which can be attained with the teachings of this disclosure for the production of a chromium copper contact. A typical manufacturing procedure utilizing the teaching of this invention would be:

1. preblend up to 10% by weight of copper powder with chromium powder;
2. press to approximately 15 tons per square inch and eject the desired compact shape from the die;
3. presinter (a) 1 hour at 1050°C if machining is required, or (b) one hour at 1200°C if outgassing and an increased chromium particle fusion is desired;
4. machine, if necessary;
5. final high temperture vacuum sinter and copper infiltration at 1200°C;
6. coining or surface conditioning, if necessary, The above procedure has been experimentally tried with copper powder additions of 2, 4, 8 and 10%. Although only these concentrations have been tried experimentally, it is felt that other concentrations may be useful in some circumstances. As the copper content and/or the compacting pressure is increased, the as pressed compact density and rupture strength will increase. The transverse rupture strength of a compact is determined by subjecting the sample to a uniformly increasing transverse loading under controlled conditions usng a three point rupture test apparatus. The procedure for powder metallurgical samples is described in METAL POWDERS INDUSTRIES FEDERATION STANDARD 15-2. The following table shows the transverse rupture strength as a function of the copper addition and compacting pressure.

TABLE 1

Green Compact Properties

| | Grade 98 Cr + Glidden 150 RXL Cu | | Grade 98 Cr + Whitaker Cu | |
|---|---|---|---|---|
| | Density g/cc | Transverse Rupture psi | Density g/cc | Transverse Rupture psi |
| Cr 10% Cu | | | | |
| 20 TSI | 5.12 to 5.20 | 120 to 140 | | |
| 15 TSI | 4.84 to 4.89 | 51 to 68 | | |
| 12 TSI | 4.55 to 4.63 | 10 to 27 | | |
| Cr 8% Cu | | | | |
| 20 TSI | 5.12 to 5.13 | 120 to 130 | 4.84 & 4.98 | 110 to 130 |
| 15 TSI | 4.69 to 4.82 | 41 to 48 | 4.56 & 4.57 | 30 to 40 |
| 12 TSI | 4.53 to 4.60 | 12 to 20 | 4.40 & 4.48 | 20 |
| Cr 4% Cu | | | | |
| 20 TSI | 5.02 to 5.03 | 67 to 83 | 4.80 & 4.83 | 70 to 80 |
| 15 TSI | 4.66 to 4.71 | 12 to 25 | 4.44 | 10 to 20 |
| 12 TSI | — | | 4.27 | 10 |
| Cr 2% Cu | | | | |
| 20 TSI | | | 4.70 & 4.76 | 50 |
| 15 TSI | | | 4.35 & 4.39 | 10 |
| 12 TSI | | | 4.16 | 3 |
| Cr 20 TSI | | | 4.69 | 0 |
| 15 TSI | | | | No Compact |
| 12 TSI | | | | No Compact |

The copper additive improves the compact green strength and makes die ejection possible without varying substantially from the desired 35% to 65% porosity of the chromium matrix. A compact produced from the blend utilizing the disclosed copper addition produces a higher green strength compact enabling die ejection and permitting subsequent handling. The low percentage of copper added and the slightly higher compacting pressure do not adversely affect the sintering of the chromium or the final properties of the contact.

The necessary calculations for determining compact weight, alloy density and percent of density were derived using the theoretical density of the chromium 7.19 gm/cc and copper 8.96 gm/cc. The chromium copper pre-press blend densities of 4, 8 and 10% by weight of copper are 7.25, 7.31 and 7.33 gm/cc, respectively. These values were calculated using the binary formula for the theoretical density of an alloy:

$$C_{alloy} = \frac{C_x C_y}{C_x W/o_y + C_y W/o_x}$$

Only a minimal error is introduced using this procedure. The density of a test compact is derived from its weight and measured volume. The percentage of theoretical density is then calculated using the appropriate binary density. Therefore, only calculations involving theoretical density are included in the minimal error category. Though theoretical densities may be slightly erroneous they are representative values of the processing and are reproducible.

The weight for an approximately 40% porosity compact was derived by taking 60% of the calculated compact volume times the density of pure chromium. Then the desired copper addition was an appropriate percentage of the compact weight. Consequently, the void volume increases to more than 40%. For example:

| | |
|---|---|
| Compact volume | = 42.6 cc |
| Compact weight 0.60 × 42.6 cc × 7.19 g/cc | = 184 grams |
| 10% copper addition | |
| Copper weight 0.10 × 184 gm | = 18 grams |
| Chromium weight | = 166 grams |
| Chromium volume 166 gm ÷ 7.19 g/cc | = 23.1 cc 54% |
| Total volume available for copper | 19.5 cc 46% |
| Weight ratio copper : : chromium | 1.05/1 |

There are numerous methods of powder compaction. The most widely used and considered as the conventional technique is die compaction. There are several distinct methods of this technique, a few which are applicable to a copper chromium processing will be described:

1. Single action compaction: The pressing action is the motion of an upper punch entering the die cavity, compressing the powder against the stationary lower punch, inner surface of the die and surfaces of any core rods present. The force applied by the press is from one direction only. Ejection of the part may be from either end of the die cavity. This technique is used to produce relatively thin one level type of parts over the entire density range.
2. Double action compaction: Both the upper and lower punches simultaneously compact the powder from opposite directions. Core rods may be stationary or movable and ejection is usually by the upward motion of the lower punch. This technique may be used to produce one level parts over a broad thickness range.
3. Floating die compaction: The die and lower punch remain stationary during the initial pressing part of the cycle. The upper punch moves into the die cavity applying pressure to the powder. This pressure induces a frictional force larger than the supporting force of the die. The die then descends as the upper punch moves downward and the powder is compacted. The relative movement between the lower punch and the die, due to this movement, simulates pressure application from the lower punch. Part ejection can be from either end of the cavity. This technique can produce both of the previously described parts.

The pressure required for these compacting techniques may be either applied through a hydraulic or mechanical mechanism. Either a manual or automatic manufacturing process can utilize these mechanisms with the above compacting techniques. Any of the above described compacting techniques can be used for practicing the teaching of the present invention.

Compositional control of the chromium copper premix blend can be obtained by weighing and mixing separate powders for the individual compacts. During production a large premixed quantity of powder may cause compaction difficulty because of segregation during storage. A typical sequence for producing a compact is: (1) weigh the required amount of chromium and copper powder, (2) mix by tumbling for approximately five minutes, (3) fill the die cavity with powder, insert top punch and press at a low ram rate to a predetermined pressure, (4) hold for 15 seconds, (5) release pressure and (6) eject green compact. The density and transverse rupture strength of the porous as pressed chromium compacts are the properties of interest. The properties for various blends are listed in Table 1 above.

The advantge of a copper binder and a slight increase in compacting pressure is evident from the results. Any increase in the copper and/or compacting pressure increases the density and green strength of the compact. Also, variations in the copper and/or chromium powders can shift these values. A good compact of copper chromium has a low density or high porosity and adequate green strength. The compacts produced utilizing the teachings of the present invention are easily ejectable from the die and capable of being handled without damage.

After the green compact is ejected from the die it is sintered to provide a chromium matrix which can be infiltrated with copper. Sintering is a process by which an assembly of particles compacted under pressure or simply confined in a container metallurgically bond themselves into a coherent body under the influence of an elevated temperature and controlled atmospheric conditions. This process is important since it largely controls the size-change and chemical reactions in the green compact, which determine the strength, hardness, toughness and density of the finished contact. Other techniques can be incorporated into the sintering process such as infiltration and joining. After sintering there is only a slight change in the density of the compact but a substantial change in the strength. The realization of these increased strength levels is the function of the sintering temperature. The disclosed process of pressing with the copper binder then sintering produces a contact shape which can be used with little or no machining.

After the contact is sintered, it is infiltrated with copper to produce a chromium copper contact. Infiltration is normally employed in powder metallurgy to describe the manufacturing process in which the pores of a sintered solid are filled with a liquid metal or alloy. This procedure attains a strong porous skeleton of the high temperature phase before the lower melting point infiltrant is inserted. The liquid infiltrant is drawn into the interconnected porosity by capillary action if there is sufficient wetting between the two metals. Consequently, superior physical properties are produced with this procedure, compared to similar processes such as liquid phase sintering and green compact infiltration. Liquid phase sintering is the heating of a complete pre-mixed compact to the melting temperature of the lowest melting constituent which liquefies, saturates and deisifies the compact. The disadvantages of liquid phase sintering and green compact infiltration are voids, shrinkage and low strength.

A satisfactory infiltration technique is the positioning of the sintering contact face down in a cup of alundum powder while a wrought copper disc placed on the back of the contact assembly is heated to the infiltration temperature in vacuum. Using this technique, the contact can be completely infiltrated without distortion and with no adverse effect on the contact face. The cup and alundum powder can be used repeatedly with satisfactory results.

Using powder metallurgy teachniques it is also possible to produce a contact in which the degree of porosity of density is purposely non-uniform. Thus, for example, the green compact can have a higher porosity in the center contact area than around the outer periphery. Thus, when infiltrated, the contact's outer portions have a high chromium to copper ratio for good mechanical strength and the center contact portion has a high copper content for higher current carrying capacity when the contacts are closed. An advantage with this construction is that the high density outer portion provides additional support for the low density center during the die ejection operation.

Figure 2:
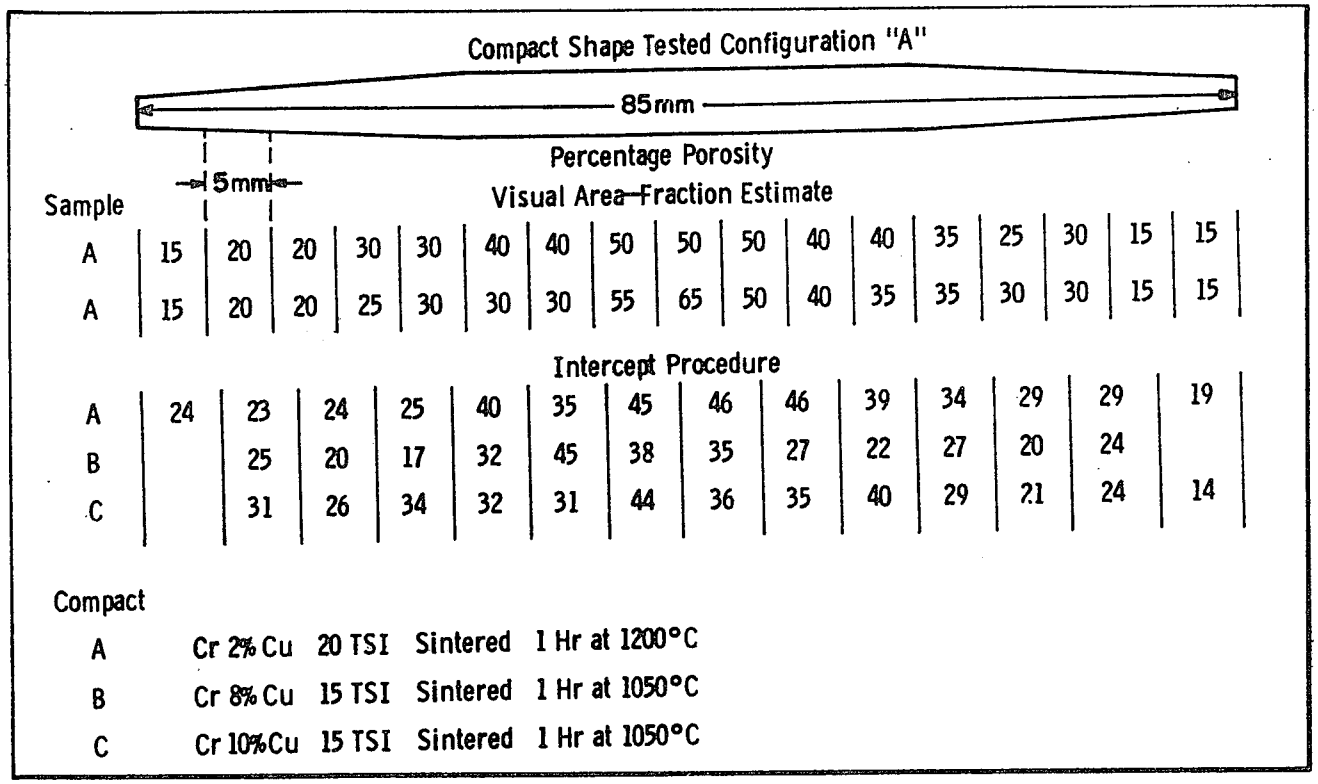
FIG. 2 shows a compact test shape having a variable density.

Two metalographic techniques were used to determine the densities of various portions of a variable density compact. First, a compact was examined using a visual aid fraction estimate procedure. This procedure compared the specimen to a visual estimate guide which consisted of a series of facsimiles of microstructure dispersions in varying percentage steps. The second technique used was an intercept point count procedure. The specimens were prepared and examined using a light microscope having a 16 point intercept grid scribed on the eyepiece. At 100X magnification the Examiner counts the number of voids positioned under an intercept. The compact shapes and results of these comparisons are shown in FIG. 2. The acceptability of a variable density compact can be rationalized by following the same procedure discussed earlier. The volume of the chromium in the compact can be calculated by using the known weight and theoretical density assuming no losses in the process. Therefore, the porosity or void volume would be equal to the compact volume less the chromium volume. For example, using a 10% copper blend:

compact volume = 45 cc; chromium value = 180 grams/7.19 grams per cc = 25 cc, approximately 56%; void volume = 20 cc, approximately 44%.

This indicates a 44% porosity which is uniformly distributed throughout a normal compact, but in a variable density compact the thinner sections have a lower porosity; and, since the peripheral areas has a thinner cross-sectional area they must have a greater chromium concentration. The thicker center portions will have a more porous chromium matrix and when infiltration is complete will have a higher concentration of copper.

The addition of copper pre-mixed with the chromium powder will improve green strength and the handleability of the pressed compact and permit a press to shape contact of a complex construction to be formed. Compacting pressures up to 20 tons per square inch in conjunction with the copper addition will produce green compacts having improved green strength with the required porosity. It has been determined that the percent of premixed copper as little effect on the properties of the compact after its first heat treatment. By proper construction a press to shape variable density contact which performs as well or better than the presently utilized chromium copper contacts can be formed. Pressing to shape reduces machining and will be a cost having over the present manufacturing processes.

I claim:

1. A method of forming a chromium copper contact for a vacuum circuit interrupter wherein the chromium content is between 40 to 60 weight percent comprising the steps of:

blending a minor addition of copper powder with a chromium powder;

pressing the blended powder in a die with a pressure of less than 20 tons per square inch to the shape desired, so that the desired chromium porosity is produced in the compact whereby the chromium content of the finished contact is between 40 to 60 weight percent;

removing the pressed compact shape from the die;

vacuum sintering for a predetermined time to form a porous chromium matrix which is preferably infiltrated with the minor addition of copper; and final sintering and fully infiltrating the chromium matrix with copper to fill the chromium matrix.

2. A method of forming a chromium copper contact for a vacuum interrupter as claimed in claim 1 wherein:

the blended minor addition of copper and chromium powder comprises less than 10% by weight of copper powder.

3. A method of producing a chromium-copper contact for a vacuum circuit interrupter comprising the steps of:

blending a predetermined amount of copper powder with a chromium powder;

pressing the blended chromium copper powder in a die to a pressure sufficient to provide the desired chromium porosity in the compact to insure that the chromium content of the finished contact in between 40 to 60 weight percent;

sintering the green compact to form a chromium matrix; and infiltrating the compact chromium matrix with copper.

4. A method of producing a contact for a vacuum circuit interrupter as claimed in claim 3 including the step of machining the sintered compact to a desired shape before copper infiltration.

5. A method of producing a contact for a vacuum circuit interrupter as claimed in claim 3 wherein:

the amount of copper powder blended with the chromium powder is less than 10 percent by weight.

6. A method of producing a contact for a vacuum circuit interrupter as claimed in claim 3 wherein:

the blended chromium copper powder is pressed to a pressure of less than 20 tons per square inch.

7. The method of forming a chromium copper contact for a vacuum circuit interrupter as set forth in claim 1 wherein, the compacting pressure is controlled to vary the chromium matrix porosity in the pressed compact shape so that the chromium density in the final contact varies in a desired relationship.

* * * * *